US007994887B2

(12) United States Patent
Yang

(10) Patent No.: US 7,994,887 B2
(45) Date of Patent: Aug. 9, 2011

(54) OUTDOOR DRY TRANSFORMER HAVING SHIELD MADE OF HIGH FUNCTIONAL FIBER

(75) Inventor: Tae-Jin Yang, Gaepo-dong Kang-nam-gu (KR)

(73) Assignee: Dong Bang Electric Ind., Ltd., Danwon-gu Ansan, Kyunki-do (KR)

( * ) Notice: Subject to any disclaimer, the term of this patent is extended or adjusted under 35 U.S.C. 154(b) by 598 days.

(21) Appl. No.: 12/161,726

(22) PCT Filed: Dec. 14, 2006

(86) PCT No.: PCT/KR2006/005484
§ 371 (c)(1),
(2), (4) Date: Jul. 22, 2008

(87) PCT Pub. No.: WO2007/086650
PCT Pub. Date: Aug. 2, 2007

(65) Prior Publication Data

US 2011/0043312 A1 Feb. 24, 2011

(30) Foreign Application Priority Data

Jan. 26, 2006 (KR) ..... 10-2006-0008546

(51) Int. Cl.
*H01F 27/02* (2006.01)
*H01F 27/32* (2006.01)

(52) U.S. Cl. ..... 336/84 R; 336/90

(58) Field of Classification Search ..... 336/84 R, 336/90, 59–60
See application file for complete search history.

(56) References Cited

U.S. PATENT DOCUMENTS

| | | | | |
|---|---|---|---|---|
| 3,867,657 | A * | 2/1975 | Yates et al. | 310/68 D |
| 3,974,599 | A * | 8/1976 | Grosh | 52/20 |
| 4,095,204 | A * | 6/1978 | Miyamoto et al. | 336/57 |
| 6,381,834 | B1 * | 5/2002 | May | 29/606 |
| 7,000,410 | B2 * | 2/2006 | Hutchinson | 62/93 |
| 7,498,917 | B1 * | 3/2009 | Yang | 336/90 |
| 2004/0251237 | A1 * | 12/2004 | Meyer et al. | 218/43 |
| 2005/0003199 | A1 * | 1/2005 | Takaya et al. | 428/413 |
| 2010/0085775 | A1 * | 4/2010 | Niess | 363/15 |

FOREIGN PATENT DOCUMENTS

| | | | |
|---|---|---|---|
| JP | 8130128 | A | 5/1996 |
| JP | 9050919 | A | 2/1997 |

* cited by examiner

*Primary Examiner* — Anh T Mai
(74) *Attorney, Agent, or Firm* — Fox Rothschild LLP; Perry M. Fonseca; Richard C. Woodbridge

(57) ABSTRACT

An outdoor dry transformer having a shield made of a high functional fiber. The transformer includes a transformer body having a core and first and second coils wound on the core; a shield surrounding the transformer body, the shield comprising a high functional fiber material which is capable of blocking moisture penetration from outside and has breathability; and a transformer housing having at least one vent in side and bottom faces thereof, the transformer housing configured to house the transformer body and the shield therein. The transformer does not use the insulating oil, thereby preventing any fire induced from the insulating oil. It is also possible to prevent environmental pollution caused by polychlorinated biphenyl as well as save resources.

19 Claims, 3 Drawing Sheets

[Fig. 1]
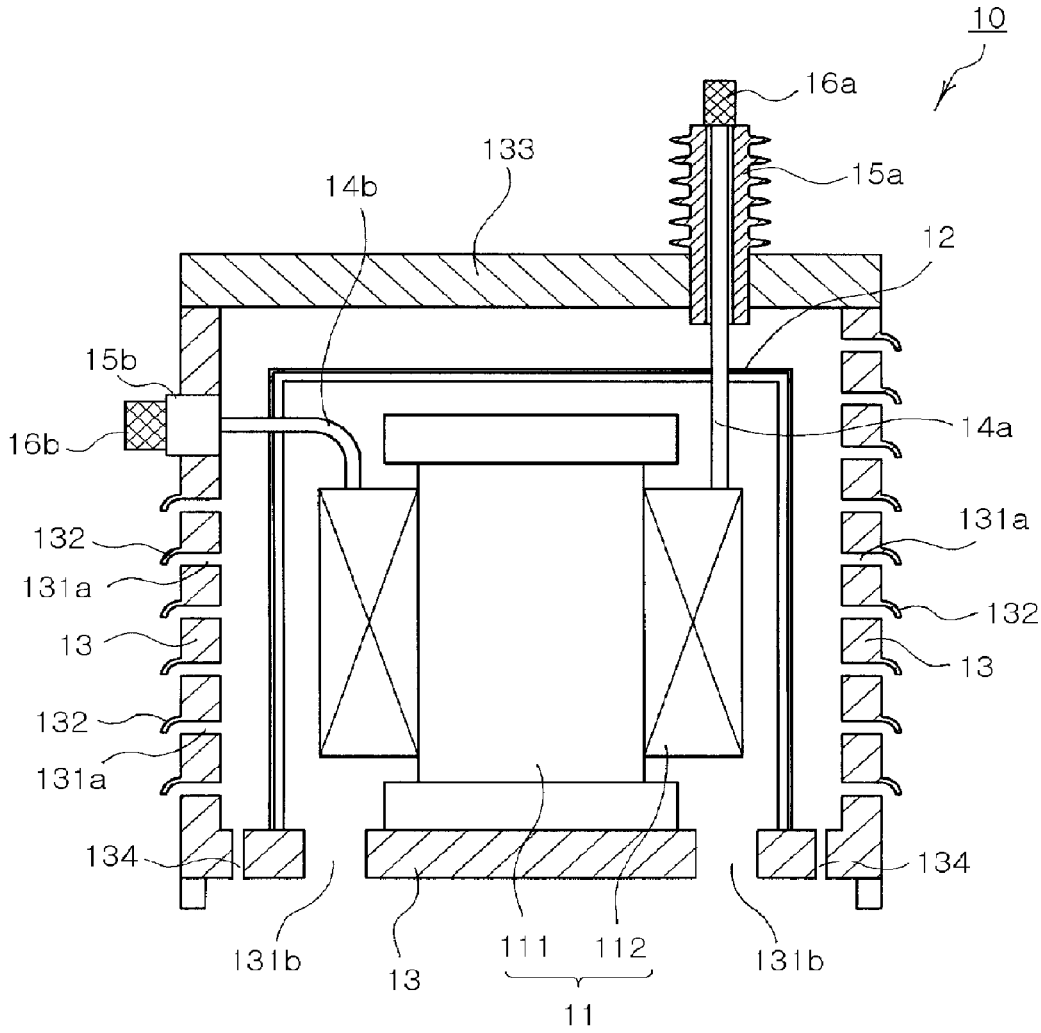

[Fig. 2]
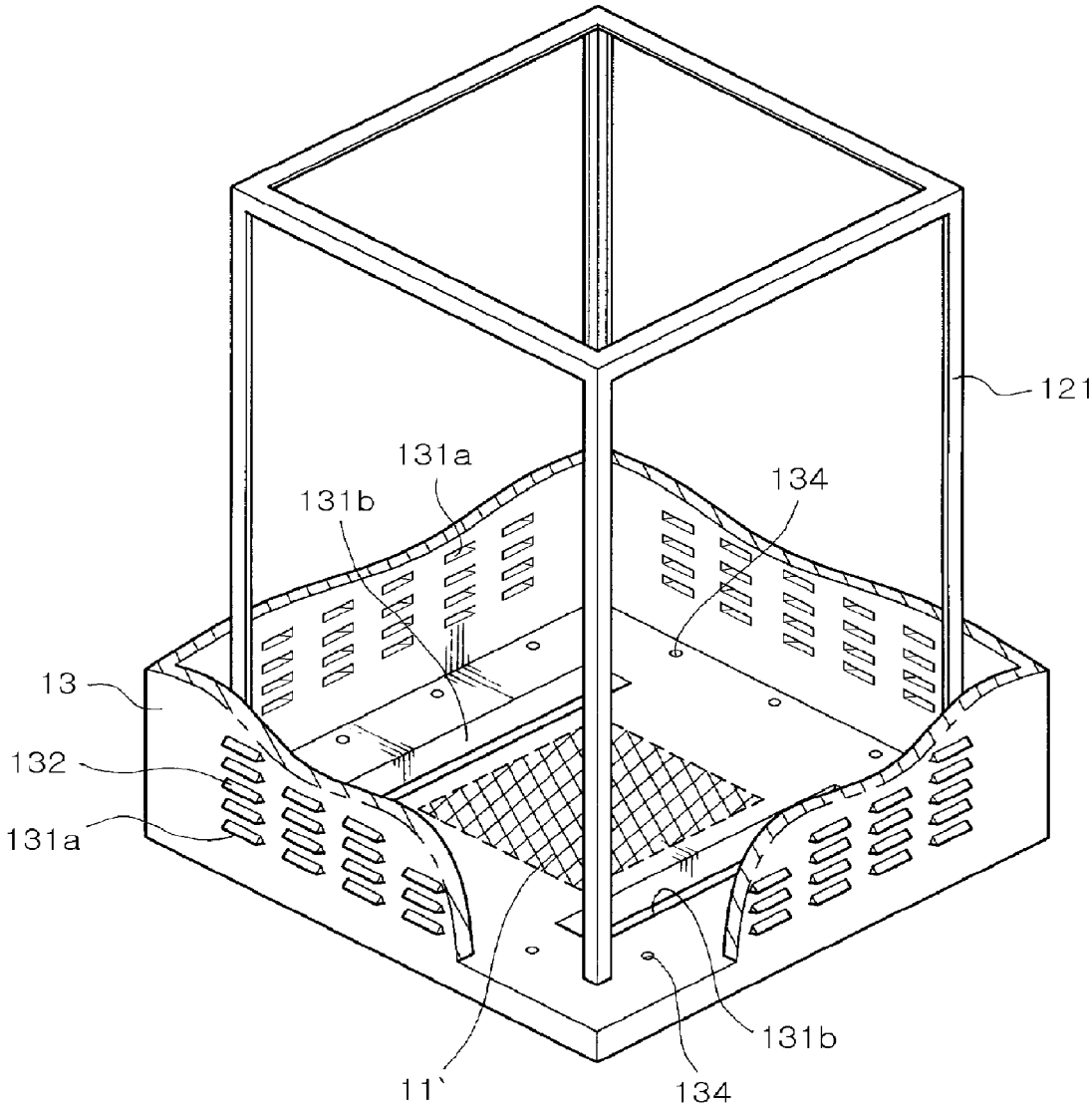

[Fig. 3]
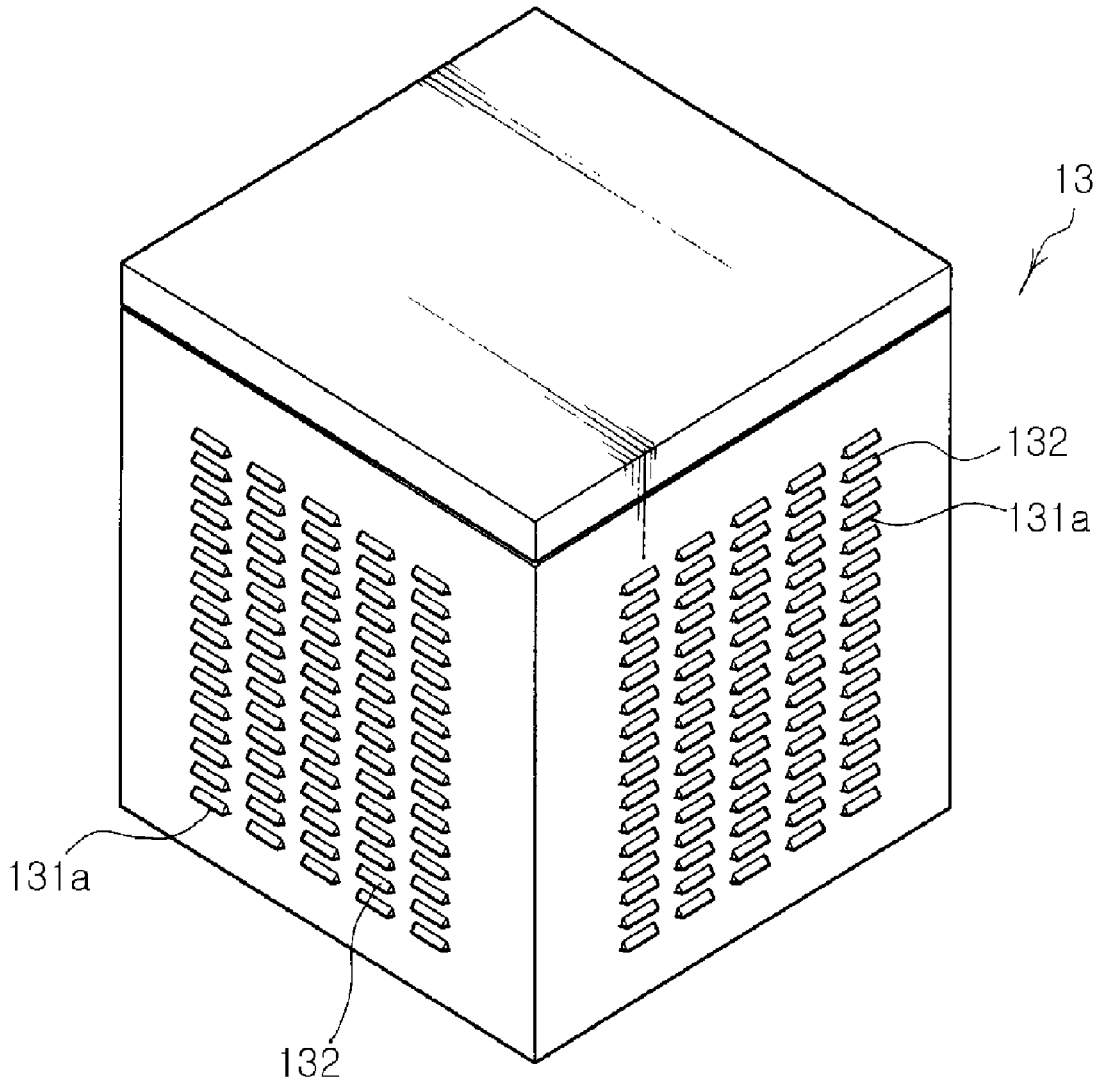

OUTDOOR DRY TRANSFORMER HAVING SHIELD MADE OF HIGH FUNCTIONAL FIBER

CROSS REFERENCE TO RELATED APPLICATIONS

This application claims the priority of PCT/KR2006/005484 filed on Dec. 14, 2006, and Korean Application 10-2006-0008546 filed on Jan. 26, 2006, the entire contents of which are hereby incorporated in total by reference.

TECHNICAL FIELD

The present invention relates to a transformer, and more particularly, to an outdoor dry transformer having a shield made of high functional fiber. The outdoor dry transformer of the invention is robust to external influence such as moisture, and can exhaust heat generated from a transformer body composed of a core and coils easily to outside without having to use insulating oil.

BACKGROUND ART

In general, transformers are classified into indoor and outdoor transformers according to places where they are installed or into dry and oil transformers according to the use of insulating oil.

As the indoor transformer, a fire retardant dry transformer is mainly used in view of the prevention of disaster in a place where it is installed. Examples of the indoor transformer may include an impregnated transformer (e.g., a mold transformer) and an unpotted transformer (e.g., a Vacuum Pressure Impregnation (VPI) transformer). In case of a 22.9 kV dry transformer, a technique of placing a coil into a mold and performing vacuum molding by using epoxy resin and the like has been conventionally used in order to maintain insulation to a high voltage of the first side. Recently, the coil itself is vacuum/pressure varnished instead of being molded with epoxy resin.

However, in a case where the dry transformer is installed outdoor, external influence such as rain, wind, moisture and dust may disable the insulation of the coil thereby causing a serious problem. Accordingly, the dry transformers are generally limited to indoor applications. For outdoor applications, oil transformers are being adopted, in which insulating oil is used to insulate a transformer body composed of coils and a core.

Such an oil transformer is fabricated by placing a transformer body into a housing and filling insulating oil into the housing for the purpose of coil insulation and cooling. A radiator may also be provided to the housing to facilitate the circulation of the insulating oil owing to heat as well as to expand heat radiating area, thereby improving cooling efficiency.

For the insulating oil filled in the conventional transformer for power distribution, silicone oil or mineral oil has generally been used. However, the silicone or mineral oil disadvantageously has a low permittivity. Furthermore, the mineral oil has a low burning point of about 140° C., which involves a risk of explosion. To overcome such a problem, an approach of using the silicone oil having a burning point of 300° C. was proposed. However, the silicone oil does not circulate well inside the transformer owing to rather poor viscosity, thereby degrading cooling efficiency. Furthermore, since the insulating oil is a type of industrial oil counter to environmental requirements, it may disadvantageously cause environmental pollution when leaked or discarded from the transformer. In particular, when used for a long term, the insulating oil produces polychlorinated biphenyl (PCB) that has a fatal effect to the human body.

Accordingly, there have been urgent demands for a novel approach in the art, by which the dry transformer that does not use the insulating oil but its use has generally been restricted to indoor applications can be used for outdoor applications in hostile environments.

DISCLOSURE OF INVENTION

Technical Problem

The present invention has been made to solve the foregoing problems of the prior art and therefore an object of certain embodiments of the present invention is to provide an outdoor dry transformer having a shield made of high functional fiber, which can realize a robust structure to external influence such as moisture, thereby maintaining excellent insulation of coils, and exhaust heat generated from a transformer body composed of a core and coils easily to outside without having to use insulating oil.

Technical Solution

According to an aspect of the invention, the invention provides an outdoor dry transformer. The outdoor dry transformer includes a transformer body having a core and first and second coils wound on the core; a shield surrounding the transformer body, the shield comprising a high functional fiber material which is capable of blocking moisture penetration from outside and has breathability; and a transformer housing having at least one vent in side and bottom faces thereof, the transformer housing configured to house the transformer body and the shield therein.

According to an embodiment of the invention, the shield further comprises a frame extending from a bottom of the transformer housing, and wherein the functional fiber material of the shield is attached, at a part thereof, to the frame to surround the transformer body.

According to another embodiment of the invention, the functional fiber material of the shield is attached to an interior of the transformer housing.

According to further another embodiment of the invention, the shield further comprises a frame extending inward from a bottom of the transformer housing, and wherein the functional fiber material of the shield comprises a first fiber material attached, at a part thereof, to the frame to surround the transformer body and a second fiber material attached to an interior of the transformer housing.

Preferably, the transformer housing further comprises moisture-blocking means for blocking moisture from flowing into the vent in the side face of the transformer, the moisture blocking means extending downward from above the vent.

Preferably, the transformer housing comprises steel or Fiberglass Reinforced Plastic (FRP). The outdoor dry transformer may further include an air filter provided in the vent to block moisture and pollutants contained in air blowing in from outside. The air filter is adapted to block moisture and pollutants introduced on air from outside, and may be made of the same material as the functional fiber material.

Preferably, the transformer housing may have at least one drain hole formed in a bottom thereof to discharge moisture out of an interior of the transformer housing.

According to another embodiment of the invention, the outdoor dry transformer may further include an insulating plate arranged between the transformer body and the transformer housing. The insulating plate is preferably arranged adjacent to the first coil of the transformer body to which a high voltage is supplied.

According to an aspect of the invention, the functional fiber material preferably comprises a weave, knit or nonwoven cloth made of at least one selected from the group consisting of polyolefin fibers including polyethylene and polypropylene, polyamide fibers, polyester fibers, polyurethane fibers, acrylic fibers, polyvinylalcohol fibers, polyvinylidene chloride fibers, polychloro trifluoroethylene fibers, metal fibers, glass fibers, aramid fibers, carbon fibers and ceramic fibers.

Preferably, the functional fiber comprises a plurality of plies of the weave, knit or nonwoven cloth, which are laminated by bonding. In this case, the functional fiber material comprises preferably a Gore-Tex® membrane or Teflon®, and more preferably, the Gore-Tex® membrane.

In the embodiment where the functional fiber material is the nonwoven cloth, the functional fiber material comprises a first fused fiber made of a high performance thermoplastic resin and a second reinforcing fiber, the first and second fibers mixed at a ratio of 1:9 to 9:1.

In this embodiment, the fused fiber is preferably one selected from the group consisting of polyolefin fibers including polyethylene and polypropylene, polyamide fibers, polyester fibers and mixtures thereof. The reinforcing fiber is preferably one selected from the group consisting of metal fibers, glass fibers, aramid fibers, carbon fibers, ceramic fibers and mixtures thereof.

Furthermore, the nonwoven cloth is preferably at least one additive selected from the group consisting of polytetrafluoroethylene (PTFE) fibers or powder, polyimide (PI) fibers, aramid fibers, carbon fibers, polyphenylene sulfide (PPS) fibers, ceramic fibers and graphite. Preferably, the nonwoven cloth comprises a Gore-Tex® membrane extrusion laminated to a thickness of substantially 0.01 mm to 0.05 mm.

Advantageous Effects

According to the present invention, by shielding the transformer body of the transformer with the functional fiber having multi-functions such as waterproof property, breathability, moisture permeability and insulating property, it is possible to use a dry transformer body for outdoor applications, which has been restricted to indoor applications conventionally.

Unlike the oil transformers which have conventionally been used for outdoor transformers, the transformer according to any of the exemplary embodiments do not use the insulating oil, thereby preventing any fire induced from the insulating oil. It is also possible to prevent environmental pollution caused by polychlorinated biphenyl (PCB) as well as save resources.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a cross-sectional view illustrating an outdoor dry transformer having a shield made of high functional fiber according to an embodiment of the invention;

FIG. 2 is a partially broken perspective view illustrating an exemplary shield of the outdoor dry transformer shown in FIG. 1;

FIG. 3 is a perspective view illustrating an exterior of the outdoor dry transformer shown in FIG. 1.

MODE FOR THE INVENTION

FIG. 1 is a cross-sectional view illustrating an outdoor dry transformer 10 according to an embodiment of the invention.

Referring to FIG. 1, the outdoor dry transformer 10 of this embodiment includes a transformer body 11, a shield 12 surrounding the transformer body 11 and a transformer housing 13 in which the transformer body 11 and the shield 12 are housed therein.

The transformer body 11 includes a core 111 and first and second coils 112 wound on the core 111. Fasteners for fixing the core 111 may be arranged respectively on upper and lower portions of the core 111. The transformer body 11 has a structure applicable to a generally known dry transformer. In the transfer body 11 shown in FIG. 1 applicable to a mold transformer as an impregnated transformer among dry transformers, the first coil (high voltage coil) and the second coil (low voltage coil) are vacuum molded separately by using epoxy resin and the like. Then, the solid insulated first and second coils are arranged coaxially around the core 111. As an alternative, in a transformer body structure applicable to a Vacuum Pressure Impregnation (VPI) transformer, that is, a type of the dry transformer, a coil itself is vacuum/pressure varnished and then wound on the core 111. Furthermore, although FIG. 1 shows the transformer body 11 having a single phase shell-type structure, the transformer body 11 of the invention can employ various types of core-coil structure such as a single phase core-type transformer and three-phase core-type transformer which are well-known in the art.

The shield 12 is arranged to surround the transformer body 11, and may be made of high functional fiber capable of blocking moisture penetration from outside and having breathability. FIG. 2 is a partially broken perspective view illustrating an example of the shield 12 of the outdoor dry transformer shown in FIG. 1. As shown in FIG. 2, the shield 12 includes a frame 121 extending inward from the bottom of the transformer housing 13 and a functional fiber material (not shown in FIG. 2 to depict the structure of the frame 121) attached to a portion of the frame 121 to surround the transformer body. In this embodiment, the frame 121 is arranged outside a position 11' where the transformer body is located so that the functional fiber material surrounds the transformer body 11.

In another embodiment of the invention, the shield may be composed of a functional fiber material (not shown) attached to the interior of the transformer housing 13 without any frame. In further another embodiment of the invention, two types of shields may be provided. That is, the shields may include a shield of functional fiber attached to a frame and another shield of functional fiber attached directly to the interior of the housing.

The main feature of this invention is the functional fiber material surrounding the transformer body 11. That functional fiber material preferably has water resistance to block moisture penetration from outside, excellent breathability in inward and outward directions and moisture permeability to discharge moisture from inside. In addition, the functional fiber preferably has heat resistance, fire retardancy, insulating property, electromagnetic shielding property and so on. The functional fiber material of this invention will be described in more detail as follows.

The transformer housing 13 is adapted to contain the transformer body 11 and the shield 12 therein, and has vents 131*a* and 131*b* in side and bottom faces thereof. In addition, the transformer housing 13 may have at least one drain hole in the bottom face to discharge moisture. This structure will be more apparent when referring to FIG. 2 together with FIG. 3 that illustrates the exterior of the outdoor dry transformer of the invention. While the transformer housing 13 is illustrated as a rectangular parallelepiped in FIGS. 2 and 2, this is not intended to limit the invention. Rather, it will be apparent to those skilled in the art that various alterations and modifications can be made without departing from the scope of the invention.

The vents 131*a* are formed in the side face of the transformer housing 13, and moisture blocking means 132 may be formed above the vents 131, which are extended downward form the housing 131 to prevent penetration of moisture such as raindrops falling down from upside and dewdrops formed outside the transformer housing 13.

The transformer housing 13 also has the vents 131*b* formed in the bottom thereof, each of which has a relatively larger area than that of each of the vents 131*a*. With the vents 131*a* and 13*b* formed in the side face and bottom of the transformer housing 13, a large amount of air is introduced into the transformer housing 131 from outside through the vents 131*b* formed in the bottom, and then dispersed out through the vents 131 in the side face of the transformer housing 13, thereby easily discharging heat from the transformer body 11 to outside.

Air filters (not shown) capable of filtering fine dust and moisture from air may be provided in the vents 131*a* and 131*b* of the transformer housing 13. In particular, the air filters are more preferably provided in the vents 131*b* that function to introduce a large amount of air into the housing 13. Since it is preferable that the air filters have waterproof property capable of blocking moisture penetration from outside, excellent breathability in inward and outward directions and moisture permeability to discharge moisture from inside, the air filters are preferably made of the same material as the functional fiber of the shield.

Furthermore, a drain hole may be provided in the bottom of the housing 13 to discharge moisture out of the housing 13 in a case where the moisture penetrates into the housing 13 or is formed therein.

In the meantime, a first bushing 15*a* and a second bushing 15*b* are arranged in specific areas of the outer surface of the transformer. A first terminal 16*a* is installed at the end of the first bushing 15*a*, and connected to a first coil of the transformer body 11 through a first lead wire 14*a* to be supplied with a high supply voltage (e.g., 22.9 kV). A second terminal 16*b* is installed at the end of the second bushing 15*b*, and connected to a second coil of the transformer housing 11 through a second lead wire 14*b* to output a low supply voltage.

In the transformer, a second side voltage outputted from the second coil to the second terminal 16*b* through the second lead wire 14*b* is generally a low voltage and thus there is no problem related with insulation in the second side voltage. However, a first side voltage inputted through the first terminal 16*a* and transferred to the first coil through the first lead wire 14*a* is an especially high voltage. Thus, in a case where the transformer housing 13 is made of steel, there may be an insulation related problem between the first coil and the transformer housing 13. Such an insulation related problem may also take place between the first coil and the first terminal 16*a*. In order to overcome the insulation related problems in the first side, an insulating plate (not shown) may also be arranged between the transformer body 11 and the transformer housing 13. In particular, the insulating plate is preferably arranged adjacent to the first coil of the transformer body 11 where the high voltage is introduced. The insulating plate may electrically isolate the first coil from outside by using the shield 12 having an insulating property, thereby insulating the first coil from the transformer housing 13.

As an alternative approach to overcome the insulation problem in the first side of the transformer, the first lead wire 14*a* may be provided as an insulated wire to insulate the first coil from the first terminal 16*a* of the transformer body 11, which is an input terminal.

As another alternative approach to overcome the insulation related problem in the first side of the transformer, the transformer housing 13 itself may be made of a non-conductive material such as Fiberglass Reinforced Plastic (FRP) to basically eliminate the insulation problem.

Furthermore, the above-mentioned several insulating approaches may be adopted in combination.

As described hereinbefore, according to an aspect of the invention, the high functional fiber material having various and beneficial functions is applied to the transformer.

According to an aspect of the invention, the functional fiber material applicable to the transformer of the invention may include but not limited to weaves, knits and nonwoven cloths made of at least one selected from the group consisting of polyolefin fibers such as polyethylene and polypropylene, polyamide fibers, polyester fibers, polyurethane fibers, acrylic fibers, polyvinylalcohol fibers, polyvinylidene chloride fibers, Polychloro trifluoroethylene fibers, metal fibers, glass fibers, aramid fibers, carbon fibers and ceramic fibers.

In a preferable embodiment of the invention, the weave, knit or nonwoven cloth may be composed of a plurality of plies which are laminated one on another by bonding. In this case, respective fiber materials having different functions may be bonded together into plural plies so that each fiber material can realize its own function. Preferably, on the top layer of the weave, knit or nonwoven cloth, a material such as Gore-Tex® membrane and Teflon®, and more preferably, Gore-Tex® membrane may be applied.

In another embodiment of the invention, the functional fiber applicable to the transformer may include but not limited to commercially available fiber materials such as Gore-Tex® (Gore company of the United States), Aquasel® (Hyosung, Korea) Warel® (Hyosung), Aerocool® (Hyosung), Coolmax®, X-Static® and 3XDRY® (Schoeller company), and most preferably, Gore-Tex®.

In a specifically preferable embodiment of the invention, the functional fiber material applicable to the transformer is a functional fibrous nonwoven cloth composed of a first fused fiber made of a high performance thermoplastic resin and a second reinforcing fiber, in which the first and second fibers are mixed at a ratio of 1:9 to 9:1.

The fused fiber may be selected from but not limited to polyolefin fibers such as polyethylene and polypropylene, polyamide fibers, polyester fibers and mixtures thereof. In addition, the reinforcing fiber may be selected from but not limited to metal fibers, glass fibers, aramid fibers, carbon fibers, ceramic fibers and mixtures thereof.

Furthermore, other additives may be contained in the nonwoven cloth to impart a specific property such as electromagnetic shielding, thermal conductivity, impact strength, thermal resistance and abrasion resistance. The additives may include but not limited to at least one selected from the group consisting of polytetrafluoroethylene (FIFE) fibers or powder, polyimide (PI) fibers, aramid fibers, carbon fibers, polyphenylene sulfide (PPS) fibers, ceramic fibers and graphite. In particular, a nano-scale carbon fiber is preferable. Such additives may be used, for example, in the form of powder, fiber, filament, Fibrid or pulp.

According to an aspect of the invention, the functional fibrous nonwoven cloth of the invention is obtained by extruding Gore-Tex® membranes to a thickness of about 0.01 to 0.05 . The Gore-Tex® membrane is a functional material having perfect waterproof property, excellent moisture permeability, windproof property and heat resistance. In this invention, the nonwoven cloth where the Gore-Tex® membranes are extrusion-laminated is applied to the transformer to have moisture permeability that can block moisture penetration from outside the transformer and discharge any moisture out of the transformer. With such property, it is possible to prevent any problems associated with moisture inside the transformer. Furthermore, the Gore-Tex® membrane endures a high temperature up to 350° F. and thus can resist against heat generated from the transformer body.

Herein, the term "nonwoven cloth" is used comprehensively to define a generally planar structure that is flat, flexible and porous. The nonwoven cloth may be made of for example staple fibers or continuous filaments. For the detailed explanation on the nonwoven cloth, confer to "*Nonwoven fabric primer and references sampler*," Association of the Nonwoven fabrics Industry, 3rd Edition (1992), by E. A. Vaughn.

Any process known in the art can fabricate the nonwoven cloth of this invention. In particular, the nonwoven cloth may be fabricated by any one of carded, spun-bonded, wet-laid, air-laid and melt blown techniques and combinations thereof. The nonwoven cloth fabricated in this technique has a final thickness of about 0.05 mm to 2 cm. By means of adhesive known in the art, the nonwoven cloth obtained like this can be applied to the inner surface of the frame or housing according to exemplary embodiments of the invention.

While the present invention has been described with reference to the particular illustrative embodiments and the accompanying drawings, it is not to be limited thereto but will be defined by the appended claims. It is to be appreciated that those skilled in the art can substitute, change or modify the embodiments into various forms without departing from the scope and spirit of the present invention.

The invention claimed is:

1. An outdoor dry transformer comprising:

a transformer body having a core and first and second coils wound on the core;

a shield surrounding the transformer body, the shield comprising a high functional fiber material which is capable of blocking moisture penetration from outside and has breathability; and a transformer housing having at least one vent in side and bottom faces thereof, the transformer housing configured to house the transformer body and the shield therein.

2. The outdoor dry transformer according to claim 1, wherein the shield further comprises a frame extending from a bottom of the transformer housing, and wherein the functional fiber material of the shield is attached, at a part thereof, to the frame to surround the transformer body.

3. The outdoor dry transformer according to claim 1, wherein the functional fiber material of the shield is attached to an interior of the transformer housing.

4. The outdoor dry transformer according to claim 1, wherein the shield further comprises a frame extending inward from a bottom of the transformer housing, and;

Wherein the functional fiber material of the shield comprises a first fiber material attached, at a part thereof, to the frame to surround the transformer body and a second fiber material attached to an interior of the transformer housing.

5. The outdoor dry transformer according to claim 1, wherein the transformer housing further comprises moisture blocking means for blocking moisture from flowing into the vent in the side face of the transformer, the moisture blocking means extending downward from above the vent.

6. The outdoor dry transformer according to claim 1, wherein the transformer housing comprises steel or Fiberglass Reinforced Plastic (FRP).

7. The outdoor dry transformer according to claim 1, wherein the transformer housing has at least one drain hole formed in a bottom thereof to discharge moisture out of an interior of the transformer housing.

8. The outdoor dry transformer according to claim 1, further comprising an insulating plate arranged between the transformer body and the transformer housing.

9. The outdoor dry transformer according to claim 1, further comprising an air filter provided in the vent to block moisture and pollutants contained in air blowing in from outside.

10. The outdoor dry transformer according to claim 9, wherein the air filter is made of the functional fiber material.

11. The outdoor dry transformer according to claim 1, wherein the functional fiber material comprises a weave, knit or nonwoven cloth made of at least one selected from the group consisting of polyolefin fibers including polyethylene and polypropylene, polyamide fibers, polyester fibers, polyurethane fibers, acrylic fibers, polyvinylalcohol fibers, polyvinylidene chloride fibers, polychloro trifluoroethylene fibers, metal fibers, glass fibers, aramid fibers, carbon fibers and ceramic fibers.

12. The outdoor dry transformer according to claim 11, wherein the functional fiber comprises a plurality of plies of the weave, knit or nonwoven cloth which are laminated by bonding.

13. The outdoor dry transformer according to claim 11, wherein the functional fiber material comprises a Gore-Tex® membrane or Teflon®.

14. The outdoor dry transformer according to claim 1, wherein the functional fiber material comprises a first fused fiber made of a high performance thermoplastic resin and a second reinforcing fiber, the first and second fibers mixed at a ratio of 1:9 to 9:1.

15. The outdoor dry transformer according to claim 14, wherein the fused fiber comprises one selected from the group consisting of polyolefin fibers including polyethylene and polypropylene, polyamide fibers, polyester fibers and mixtures thereof.

16. The outdoor dry transformer according to claim 14, wherein the reinforcing fiber comprises one selected from the group consisting of metal fibers, glass fibers, aramid fibers, carbon fibers, ceramic fibers and mixtures thereof.

17. The outdoor dry transformer according to claim 14, wherein the nonwoven cloth comprises at least one additive selected from the group consisting of polytetrafluoroethylene (PTFE) fibers or powder, polyimide (PI) fibers, aramid fibers, carbon fibers, polyphenylene sulfide (PPS) fibers, ceramic fibers and graphite.

18. The outdoor dry transformer according to claim 14, wherein the nonwoven cloth comprises a Gore-Tex® membrane extrusion laminated to a thickness of substantially 0.01 mm to 0.05 mm.

19. The outdoor dry transformer according to claim 12, wherein the functional fiber material comprises a Gore-Tex® membrane or Teflon®.

* * * * *